US011754229B2

(12) United States Patent
Van Der Walt et al.

(10) Patent No.: US 11,754,229 B2
(45) Date of Patent: Sep. 12, 2023

(54) PROCESSES, APPARATUSES, AND SYSTEMS FOR CAPTURING PIGGING AND BLOWDOWN EMISSIONS IN NATURAL GAS PIPELINES

(71) Applicant: NEXT Carbon Solutions, LLC, Houston, TX (US)

(72) Inventors: Ivan Van Der Walt, Conroe, TX (US); Ben Heichelbech, Houston, TX (US); Connor Rivard, Houston, TX (US); Vikrum Subra, Houston, TX (US)

(73) Assignee: NEXT CARBON SOLUTIONS, LLC, Houtson, TX (US)

( * ) Notice: Subject to any disclaimer, the term of this patent is extended or adjusted under 35 U.S.C. 154(b) by 0 days.

(21) Appl. No.: 17/956,534

(22) Filed: Sep. 29, 2022

(65) Prior Publication Data

US 2023/0015138 A1 Jan. 19, 2023

Related U.S. Application Data

(62) Division of application No. 17/701,030, filed on Mar. 22, 2022, now Pat. No. 11,560,984.

(60) Provisional application No. 63/165,475, filed on Mar. 24, 2021.

(51) Int. Cl.

| | |
|---|---|
| ***F17D 3/14*** | (2006.01) |
| ***B08B 15/00*** | (2006.01) |
| ***F17D 3/16*** | (2006.01) |

(52) U.S. Cl.
CPC ..... *F17D 3/145* (2013.01); *B08B 15/002* (2013.01); *F17D 3/16* (2013.01)

(58) Field of Classification Search
CPC ..... E21B 21/063; E21B 43/34; B08B 15/002; B01D 46/00; B01D 35/02; F17D 3/145; F17D 3/16
See application file for complete search history.

(56) References Cited

U.S. PATENT DOCUMENTS

| | | | | |
|---|---|---|---|---|
| 4,160,652 | A | 7/1979 | Martin et al. | |
| 5,938,819 | A * | 8/1999 | Seery | B01D 53/053 95/902 |
| 6,248,794 | B1 | 6/2001 | Gieskes | |
| 9,102,534 | B2 | 8/2015 | McKenna | |
| 9,149,761 | B2 | 10/2015 | Northrop et al. | |
| 9,377,164 | B2 * | 6/2016 | Utal | F17C 13/123 |
| 10,315,150 | B2 | 6/2019 | Huntington et al. | |
| 10,641,076 | B2 | 5/2020 | Kunkel | |
| 11,067,335 | B1 | 7/2021 | Van der Walt et al. | |
| 11,339,639 | B2 | 5/2022 | Johnsen et al. | |
| 2003/0192343 | A1 | 10/2003 | Wilding et al. | |
| 2010/0139484 | A1 | 6/2010 | Li et al. | |
| 2010/0325958 | A1 | 12/2010 | Molaison | |

(Continued)

OTHER PUBLICATIONS

International Preliminary Report on Patentability and Written Opinion from PCT/US2020/051269, dated Mar. 8, 2023, 16 pages.

(Continued)

*Primary Examiner* — Michael R Reid
(74) *Attorney, Agent, or Firm* — K&L Gates LLP

(57) ABSTRACT

Disclosed are processes, apparatuses, and systems in natural gas pipelines to significantly reduce pigging and blowdown emissions. In an example, a process involves filtering and/or separating pigging or blowdown emissions. The filtered and/or separated pigging/blowdown products can then be stored in a storage, sent back into the natural gas pipeline at a downstream location, or sent to an adjacent pipeline.

19 Claims, 1 Drawing Sheet

(56) References Cited

U.S. PATENT DOCUMENTS

| | | | |
|---|---|---|---|
| 2016/0059180 | A1 | 3/2016 | Hamad |
| 2016/0369674 | A1 | 12/2016 | Younes et al. |
| 2017/0097189 | A1 | 4/2017 | Guy et al. |
| 2017/0333814 | A1 | 11/2017 | Yancy et al. |
| 2018/0094560 | A1 | 4/2018 | Williams et al. |

OTHER PUBLICATIONS

International Preliminary Report on Patentability and Written Opinion from PCT/US2021/046817, dated Mar. 8, 2023, 4 pages.
International Preliminary Report on Patentability and Written Opinion from PCT/US2020/046879, dated Mar. 8, 2023, 7 pages.
IEAGHG Technical Report by IEA, Techno-Economic Evaluation of CO2 Capture in LNG Plants, IEA Greenhouse Gas R&D Programme, Oct. 2019, 198 pages.
Third Party Observation from PCT/US2020/051269, Filed Sep. 17, 2020, listing the IEAGHG Technical Report, 1 page.
Supplemental Explanation for Third Party Observation from PCT/US2020/051269, Filed Sep. 17, 2020, regarding the IEAGHG Technical Report, 4 pages.
Third Party Observation from PCT/US2021/046716, Filed Aug. 19, 2021, listing the IEAGHG Technical Report, 1 page.
Supplemental Explanation for Third Party Observation from PCT/US2021/046716, Filed Aug. 19, 2021, regarding the IEAGHG Technical Report, 3 pages.
International Search Report from PCT/US2022/53201, dated Mar. 27, 2023, 2 pages.
International Written Opinion from PCT/US2022/53201, dated Mar. 27, 2023, 4 pages.
International Preliminary Report on Patentability and Written Opinion from PCT/US2020/046879, dated Mar. 8, 2023, 6 pages.

* cited by examiner

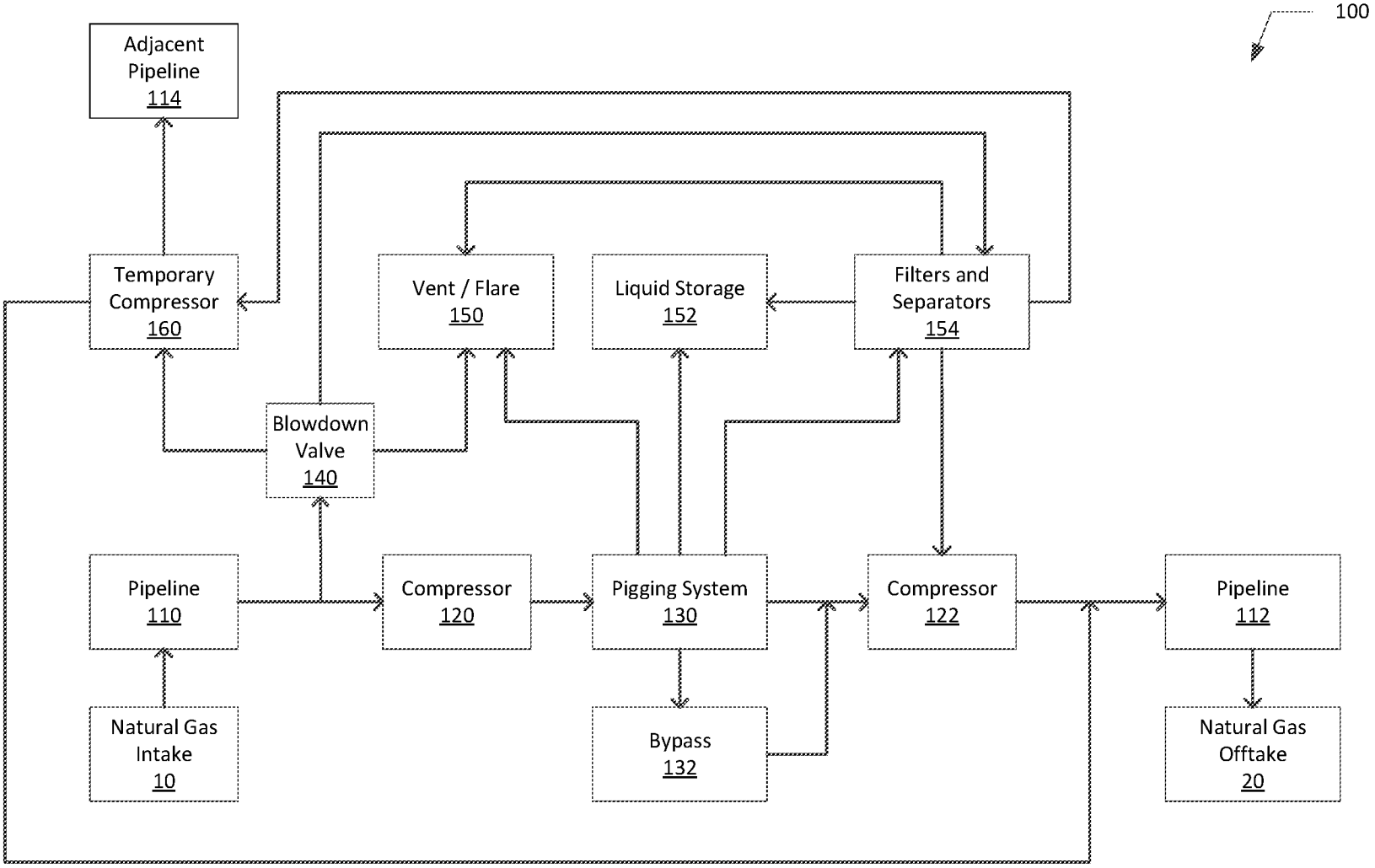
100
Adjacent Pipeline 114
Temporary Compressor 160
Vent / Flare 150
Liquid Storage 152
Filters and Separators 154
Blowdown Valve 140
Pipeline 110
Natural Gas Intake 10
Compressor 120
Pigging System 130
Bypass 132
Compressor 122
Pipeline 112
Natural Gas Offtake 20

PROCESSES, APPARATUSES, AND SYSTEMS FOR CAPTURING PIGGING AND BLOWDOWN EMISSIONS IN NATURAL GAS PIPELINES

CROSS-REFERENCE TO RELATED APPLICATION

This application is a divisional of U.S. patent application Ser. No. 17/701,030, filed Mar. 22, 2022, entitled PROCESSES, APPARATUSES, AND SYSTEMS FOR CAPTURING PIGGING AND BLOWDOWN EMISSIONS IN NATURAL GAS PIPELINES, and claims priority from U.S. Prov. App. No. 63/165,475 filed on Mar. 24, 2021, the entirety of which is incorporated herein by reference.

BACKGROUND

Natural gas pipelines often employ various operations to facilitate maintenance and upgrades in a safe manner, such as pigging operations and blowdown operations for example, which traditionally result in carbon emissions in the form of natural gas (e.g., methane) or carbon dioxide released into the atmosphere.

For example, pig devices may be used in a natural gas pipeline to clean the pipeline so as to remove liquid and solid contaminants accumulated over time, which may affect the efficiency of natural gas flow through the pipeline and/or may damage the pipeline. For instance, natural gas received from well heads may include corrosive chemicals that, when condensed to a liquid form, may slowly degrade or damage the inner walls of pipes and so on. Thus, pigging may facilitate maintaining the health of the pipeline regularly by moving a pig through a section of the pipeline to clear or remove or reduce liquids or solids from the natural gas stream in the pipeline. Intelligent or "Smart" pigs are another type of pigs commonly used to inspect pipelines to assess their condition so as to prevent leaks and other events that may be harmful to the environment. However, pigging operations typically require releasing a portion of the natural gas and/or the accumulated liquids to facilitate processes such as launching a pig, receiving a pig, replacing a pig, removing liquid slug, etc.

Blowdown operations, which are also commonly used in natural gas pipelines, typically involve releasing a blowdown gas from a pipeline at a certain location so as to temporarily depressurize or isolate a downstream component or section of the pipeline during maintenance or for some other reason. By way of example, a blowdown operation may be performed to de-pressurize a section of the pipeline so that it can be replaced or connected to another pipeline, etc.

Although operations such as pigging and blowdown have many advantages, they may also be significant sources of emissions. Such emissions, which typically include natural gas, are traditionally either vented directly into the atmosphere or combusted in a flare before being released into the atmosphere.

SUMMARY

According to one non-limiting aspect of the present disclosure, a process for capturing pigging emissions in a natural gas pipeline may comprise filtering and/or separating a product of a pigging system. The process may also comprise storing and/or compressing the filtered and/or separated product.

In one embodiment, the filtered and/or separated product may comprise a gas, and the process may comprise compressing the gas. The process may also comprise inserting the compressed gas into the natural gas pipeline at a location downstream of the pigging system to recombine the compressed gas with a gas stream flowing through the natural gas pipeline.

In one embodiment, the filtered and/or separated product may comprise a liquid, and the process may comprise storing the liquid in a liquid storage.

According to another non-limiting aspect of the present disclosure, a process for capturing blowdown emissions in a natural gas pipeline comprises transporting a blowdown gas from a blowdown valve to an in-line compressor. The process may also comprise compressing the blowdown gas using the in-line compressor. The process may also comprise sending the compressed gas into the natural gas pipeline at a location downstream of the station In one embodiment, the blowdown had and may be compressed with a temporary compressor. The process may also comprise sending the compressed gas into the natural gas pipeline at a location downstream of the blowdown valve, and/or to an adjacent gas pipeline.

Other aspects, examples, features, and advantages of the disclosed devices, systems, facilities, and methods are described in, and will be apparent from, the following Detailed Description and the FIGURES. The features and advantages described herein are not all-inclusive and, in particular, many additional features and advantages will be apparent to one of ordinary skill in the art in view of the figures and description. Also, a particular embodiment does not necessarily have all of the advantages listed herein. Moreover, it should be noted that the language used in the specification has been principally selected for readability and instructional purposes, and not to limit the scope of the inventive subject matter.

BRIEF DESCRIPTION OF THE DRAWINGS

FIG. 1 is an exemplary schematic illustration of a natural gas pipeline system that implements a process for capturing pigging and/or blowdown emissions in a natural gas pipeline, according to example embodiments of the present disclosure.

DETAILED DESCRIPTION

Although the following text sets forth a detailed description of numerous different embodiments, it should be understood that the legal scope of the invention is defined by the words of the claims set forth at the end of this patent. The detailed description is to be construed as exemplary only and does not describe every possible embodiment, as describing every possible embodiment would be impractical, if not impossible. One of ordinary skill in the art could implement numerous alternate embodiments, which would still fall within the scope of the claims. Unless a term is expressly defined herein using the sentence "As used herein, the term '_____' is hereby defined to mean . . . " or a similar sentence, there is no intent to limit the meaning of that term beyond its plain or ordinary meaning. To the extent that any term is referred to in this patent in a manner consistent with a single meaning, that is done for sake of clarity only, and it is not intended that such claim term be limited to that single meaning. Finally, unless a claim element is defined by reciting the word "means" and a function without the recital of any structure, it is not intended that the scope of any claim element be interpreted based on the application of 35 U.S.C. § 112(f).

Pigging emissions discharged from one or more outlets of a natural gas pipeline pigging system may include a portion of the gas stream transported in the natural gas pipeline, such as natural gas vented from a pig launcher or pig receiver to adjust pressures inside the pipeline so as to facilitate launching a pig from the pig launcher into the pipeline or receiving the pig from the receiver or natural gas vented to depressurize pig launcher or receiver vessels so as to safely load new pigs or remove used pigs. Blowdown emissions may similarly include natural gas released through a blowdown valve to depressurize a component or section of the pipeline downstream of the blowdown valve. Pigging emissions may also include other fluids output from a pigging system such as liquids (e.g., liquid slugs accumulated and pushed to a pig receiver or slug catcher) or solids (e.g., dust, rust, small particles, etc.) drained or discharged from a pig launcher or receiver vessel (e.g., through a drain valve) during or after a pigging operation. As noted above, pigging emissions (also referred to herein as products of the pigging system) and blowdown emissions are traditionally released into the atmosphere directly or indirectly (e.g., by burning them using a flare).

The present disclosure provides novel processes, apparatuses, and systems that can be used in natural gas pipelines to significantly reduce pigging and blowdown emissions released into the atmosphere. An example process involves creating a feedback loop downstream of pigging systems (e.g., pig launchers, pig receivers, slug catchers, etc.). For example, the discharged pigging emissions may captured and then gas (e.g., natural gas) may be filtered from the captured pigging emissions to separate liquids and other contaminants (e.g., dust, rust, etc.) from the filtered gas. The filtered gas may then be inserted back into the natural gas pipeline downstream of the pigging system so as to recombine the filtered gas with the gas stream flowing through the natural gas pipeline (after removing liquids and contaminants that may be harmful to the pipeline). Thus, the present method may enable putting at least a portion of the pigging emissions back into the pipeline instead of or in addition to releasing all of the gas back into the atmosphere (which may still be performed as a backup option or for a reduced portion of the original pigging emissions).

In some examples, discharged liquids (e.g., natural gas condensates, condensed water, etc.) in the pigging emissions can be similarly processed (e.g., filtered, separated, etc.) to extract useful portions (e.g., hydrocarbon condensates, water, dissolved natural gas, etc.). Filtered liquids may then be sent to a liquid storage or to a user (e.g., to produce fuel gas, etc.) and filtered gases can be inserted back into the pipeline at a downstream location (e.g., instead of just disposing or storing all of the discharged liquid in its impure state without extracting useful or valuable liquids and gases dissolved or mixed in the discharged fluid).

Additional examples disclosed herein enable reducing or avoiding blowdown emissions, for example, by similarly returning a filtered gas from the blowdown emissions back into the natural gas pipeline (at a downstream location) or by compressing and transporting the blowdown gas into a different (e.g., adjacent or parallel) pipeline, instead of or in addition to simply releasing (directly or after burning it using a flare) most or all of the blowdown emissions into the atmosphere.

Referring now to the FIGURES, FIG. 1 is an exemplary schematic illustration of a natural gas pipeline system 100 that implements a process for capturing pigging and/or blowdown emissions, according to example embodiments of the present disclosure.

Unless otherwise specified herein, the arrows which extend from or to various blocks as depicted in FIG. 1 represent fluid connections or conduits (e.g., piping, etc.) configured to transport a fluid (e.g., natural gas, etc.) from or to component(s) at end(s) of the respective arrows. Further, an arrow direction of a respective arrow represents a flow direction (e.g., downstream direction) of the fluid flowing inside the conduit represented by the respective arrow. For example, the arrow illustrated between natural gas intake location 10 (e.g., well heads) and pipeline 110 may represent a fluid connection that transports a gas stream from the intake location 10 to the pipeline 110.

In general, a natural gas pipeline includes a line of pipes (and other components) connected in a line to define a flow path that extends between two locations. For example, pipelines 110, 112, compressors 120, 122, and pigging system(s) 130 (e.g., pig launchers, pig receivers, slug catchers, etc.) may collectively be referred to as a natural gas pipeline that transports a gas stream from one or more intake locations 10 to one or more natural gas outtake locations 20 (e.g., customers, natural gas processing facilities, distribution facilities, industrial facilities, etc.).

In some examples, although not shown, the natural gas pipeline extending between locations 10, 20 may also include other pipelines connected to the (e.g., as branches) at various locations along the length of the natural gas pipeline. For example, multiple gathering pipelines could be connected to the pipeline 110 to transport multiple gas streams from different wellheads at different locations into the pipeline 110. Alternatively or additionally, the natural gas pipeline extending between locations 10 and 20 may include other pipelines (e.g., branches) connected to the natural gas pipeline at any other location (e.g., using valves, taps, tees, etc.) temporarily, or continuously, or selectively, etc., according to various applications.

The natural gas pipeline system 100 also includes one or more compressors 120, 122, which may be housed in compressor stations distributed along a length of the natural gas pipeline to control the flow and regulate the pressures of the gas stream inside the natural gas pipeline at the different locations (which may be miles away from each other), by compressing an incoming flow of the gas stream to a higher pressure gas stream flowing out of the compressor in the downstream direction. For example, compressor 120 may increase the pressure of the gas stream received from the pipeline 110 to a higher pressure flowing out of the compressor 120 toward the pigging system 130. In one specific embodiment, in-line compressors 120 and 122 may be implemented as natural gas boosters configured to increase the pressure of a pressurized gas stream input thereto to a higher pressure flowing out of the natural gas boosters 120, 122 (e.g., from 800 psi to 1200 psi, etc.).

The natural gas pipeline system 100 may also one or more pipelines that define a different flow path for transporting a second gas stream. For example, as shown, the system 100 may include an adjacent pipeline 114 that is not connected in series along the line of pipelines between locations 10, 20. In an example, the adjacent pipeline 114 may include a parallel pipeline configured to transport, along an at least partially separate path, a second gas stream from one or more of the same intake locations 10 and/or to one or more of the same outtake locations 20 served by the pipeline 110, 112. For example, a parallel gas line 114 may advantageously allow an operator of the system 100 to selectively increase the amount of natural gas supplied to the customer at location 20 during peak hours, as well as continue supplying the customer in the event of an interruption in the other pipeline. For example, in the event of a maintenance operation that requires disconnecting any of the components in the first pipeline (e.g., 110, 112, 120, 130, etc.), supply to all the other components downstream of the disconnected component. However, in this scenario, the adjacent parallel pipeline 114, which defines a separate flow path, may continue to supply the customer because it defines a second separate flow path for delivering the natural gas stream flowing therein.

As shown in FIG. 1, the natural gas pipeline system 100 may also include one or more pigging stations 130 (also referred to herein as a pigging system 130). The pigging systems 130 may include pig launchers, pig receivers, slug catchers, and/or any other component configured to selectively launch a pig device into the gas stream (for pigging a downstream section of the pipeline) or receiving a pig device launched from an upstream pigging system (not shown). For example, system 100 may include a pig launcher disposed upstream of the pipeline 110 to launch a pig that moves through the pipeline 110 and then is received by a pig receiver in the pigging station 130. In some examples, the system 100 may include a pigging station (e.g., a pig launcher and a pig receiver) at or near each compressor station along the length of the pipeline.

The system 100 may include a blowdown valve 140 configured to selectively discharge a portion of the gas stream (flowing in the natural gas pipeline) out of the blowdown valve 140 so as to (usually temporarily) depressurize or isolate a downstream section of the pipeline (e.g., pigging system 130, etc.) from the pressurized gas stream flowing downstream at the location of the blowdown valve 140. It is note that the system 100 may include fewer or more blowdown valve. Further, the blowdown valve 140 may be arranged to discharge gas from a different location along the natural gas pipeline than shown in the FIGURE. In general, the system 100 may include multiple blowdown valves at multiple locations along the length of the natural gas pipeline to facilitate depressurizing various components or pipeline sections of the pipeline to facilitate maintenance of the various components.

As noted above, emissions discharged from the blowdown valve 140 and/or any of the outlets of the pigging system 130 may be vented or flared directly into the atmosphere (e.g., through the vent/flare 150) or transported directly (e.g., without processing) into a liquid storage 152. For example, the arrow between pigging system 130 and the vent or flare 150 may represent a fluid connection between a first outlet of the pigging system (e.g., a vent valve of a pig launcher or receiver, etc.) that discharges gas in a pigging operation (e.g., to depressurize the pig launcher or receiver, etc.) directly to the vent or flare 150. Similarly, the arrow between the pigging system 130 and the liquid storage 152 may represent a fluid connection from an outlet (e.g., drain valve) of the pigging system 130 used to drain liquid slug from the pigging vessel. In some examples, a portion of the gas stream flowing through the pigging system 130 (other than the portion vented out) may continue to flow downstream in the natural gas pipeline through the bypass 132.

In accordance with the present disclosure, the system 100 may alternatively or additionally transport pigging emissions (e.g., vented gas stream, drained liquid slug, etc.) to a filtration and/or separation system (e.g., filters and separators 154). The filters and separators 154 may include one or more filters, separators, and/or filter separators connected to one or more outlets of the pigging system 130 to receive and process the pigging emissions produced and discharged from the pigging system 130 (also referred to herein as products of the pigging system 130).

In an example, the filters and separators 154 may include a vessel that receives the fluids discharged from the pigging system (e.g., liquid slug cleansed from an upstream pipeline, natural gas vented to depressurize a pig launcher or receiver, etc.). The vessel may include one or more filter elements, such as filters capable of removing dust, rust, small particles, oils, liquids, or any other contaminant mixed with gases discharged from the pigging system 130 and transported into the filter 154. Alternatively or additionally, the filters and separators 154 may include one or more separator elements, such as heated separators, horizontal separators, vertical separators, single-phase separators, multi-phase separators, or any other type of separator device configured separate liquids from gases (or solids) in the fluid discharge flowing into the separators 154 from one or more outlets of the pigging system 130.

In this way, various components of the pigging emissions, such as gases (even those that were mixed with the drained liquid slug), liquids (e.g., hydrocarbon condensates, water, etc.), and solid contaminants, can be processed efficiently alternatively or additionally to configurations were the raw pigging emissions are simply released to the atmosphere. Specifically, after the products of the pigging system 130 (e.g., discharged fluid, liquid slug, vented gas, etc.) are processed/passed through the filters and separators 154, in various examples, the processed products (e.g., filtered and/or separated portions of the raw discharged products) may be sent to the storage tank or facility 152, the vent or flare 150, or the compressor 122.

In an example, where the processed product comprises a filtered and/or separated gas (e.g., after potentially harmful contaminants and/or liquids are separated from the gas), the system 100 may send the filtered gas to the in-line compressor 122 (or other compressor) so as to compress the filtered gas and then insert it back into the natural gas pipeline. In an alternative or additional examples, the filtered gas may be compressed using another compressor (not shown) different than the in-line compressors 120, 122. For instance, the filtered gas may be compressed using a natural gas booster that is not connected in-line with the natural gas pipeline (i.e., a compressor that does not necessarily receive and compress the gas stream flowing in the natural gas pipeline as well as the filtered gas from the filters and separators 154). In some implementations, the compressed gas may be inserted into the pipeline at a location downstream of the pigging system 130. In an example, where the processed product comprises a filtered and/or separated.

In an example, where the processed product comprises a filtered or separated liquid (e.g., natural gas concentrate separated from contaminants, gases, water, etc.), the filtered liquid may be transported to one or more liquid storage tanks 152, such as a storage tank specific to the type of liquid purified and/or filtered in accordance with the present disclosure.

In some examples, the system 100 may alternatively or additionally be configured to send at least a portion of the processed product to the vent or flare 150 (e.g., if the processed product is less suitable for compression or insertion into the pipeline or storage in the storage tank 152 than other processed product, etc.).

As noted above, in some examples, blowdown gas (i.e., blowdown emissions) removed from the natural gas pipeline during a blowdown operation may be transported out of the natural gas pipeline through the blowdown valve 140.

In accordance with the present disclosure, in some examples, the system 100 may be configured to transport at least a portion of the blowdown gas from the blowdown valve 140 to a compressor.

In an example, the blowdown gas (or a portion thereof) may be sent to a temporary compressor 160. The temporary compressor 160, for example, may include a compressor installed in a temporary compressor station that is not in line with the pipeline from which the blowdown gas was removed. In one embodiment, the temporary compressor 160 may include a relatively stronger compressor configured to compress an incoming gas flow, even if not pressurized, to a high pressure. For instance, the in-line compressors or natural gas boosters 120, 122 may be configured to compress pressurized gas to a higher pressure (e.g., 800 psi to 1200 psi, etc.) but may be less suitable for pressurizing a low pressure or an unpressurized gas (e.g., at or near atmospheric pressure), such as the blowdown gas, to a similarly high pressure. After the blowdown gas is compressed in the temporary compressor 160, the system 100 may send the compressed gas back into the natural gas pipeline at a location downstream from the location of the blowdown valve or pigging station (e.g., downstream of the depressurized section adjacent to the valve in the pipeline). Alternatively or additionally, the system 100 may send the compressed output from the temporary compressor 160 to the adjacent pipeline 114, as depicted by the arrow between the adjacent pipeline 114 and the compressor 160 in the illustration of FIG. 1.

In an alternative or additional example, the system 100 is configured to send at least a portion of the blowdown gas exiting the natural gas pipeline through the valve 140 to the filters and separators 154. In this example, the blowdown gas (or portion thereof) is then filtered and/or separated similarly to the discussion above for the gas filtered from the pigging emissions 130. Further, the filtered and/or separated blowdown gas may also then be compressed and re-inserted into the natural gas pipeline, similarly to the filtered gas processed from the pigging emissions of the pigging system 130 in line with the discussion above.

In some examples, the system 100 may be alternatively or additionally configured to similarly send at least a portion of the pigging emissions (e.g., pigging gas) and/or the processed product (i.e., filtered and/or separated gas from the pigging emissions) to the temporary compressor 160. For example, as shown in FIG. 1, a fluid connection (e.g., pipe) can be implemented to connect an output of the filters/separators 154 to the temporary compressor station 160, which may then compress the processed product (of the pigging emissions) and send the compressed gas to the adjacent pipeline 114 and/or back into the pipeline at a location downstream of the pigging station 130.

As used in this specification, including the claims, the term "and/or" is a conjunction that is either inclusive or exclusive. Accordingly, the term "and/or" either signifies the presence of two or more things in a group or signifies that one selection may be made from a group of alternatives.

The many features and advantages of the present disclosure are apparent from the written description, and thus, the appended claims are intended to cover all such features and advantages of the disclosure. Further, since numerous modifications and changes will readily occur to those skilled in the art, the present disclosure is not limited to the exact construction and operation as illustrated and described. Therefore, the described embodiments should be taken as illustrative and not restrictive, and the disclosure should not be limited to the details given herein but should be defined by the following claims and their full scope of equivalents, whether foreseeable or unforeseeable now or in the future.

What is claimed is:

1. A process for capturing blowdown emissions in a natural gas pipeline, the process comprising:

sending a blowdown gas to a compressor, wherein the blowdown gas is removed from a gas stream in the natural gas pipeline, and wherein the blowdown gas is transported out of the natural gas pipeline through a blowdown valve;

compressing the blowdown gas; and sending the compressed gas back into the natural gas pipeline at a location downstream of the blowdown valve to recombine the compressed gas with the gas stream flowing inside the natural gas pipeline.

2. The process of claim 1, wherein the compressor is a temporary compressor different than in-line compressors used to compress the gas stream flowing through the natural gas pipeline.

3. The process of claim 1, wherein the compressor is a natural gas booster, and wherein compressing the blowdown gas is conducted by the natural gas booster.

4. The process of claim 3, wherein the natural gas booster is an in-line compressor configured to also compress the gas stream flowing through the natural gas pipeline.

5. The process of claim 1, further comprising:

separating and filtering the blowdown gas, wherein compressing the blowdown gas comprises compressing the separated and filtered blowdown gas.

6. A process for capturing blowdown emissions in a natural gas pipeline, the process comprising:

sending a blowdown gas to a compressor, wherein the blowdown gas is removed from a gas stream in the natural gas pipeline, and wherein the blowdown gas is transported out of the natural gas pipeline through a blowdown valve;

filtering the blowdown gas, wherein filtering the blowdown gas comprises removing solids or liquids; and compressing the filtered blowdown gas.

7. The process of claim 6, further comprising:

sending the compressed gas into an adjacent natural gas pipeline transporting another gas stream in the adjacent natural gas pipeline to combine the compressed gas with the other gas stream.

8. The process of claim 6, wherein the compressor is a temporary compressor different than in-line compressors used to compress the gas stream flowing through the natural gas pipeline.

9. The process of claim 6, wherein the compressor is a natural gas booster, and wherein compressing the blowdown gas is conducted by the natural gas booster.

10. The process of claim 9, wherein the natural gas booster is an in-line compressor configured to also compress the gas stream flowing through the natural gas pipeline.

11. A process for capturing blowdown emissions in a natural gas pipeline, the process comprising:

sending a blowdown gas to a compressor, wherein the blowdown gas is removed from a gas stream in the natural gas pipeline, and wherein the blowdown gas is transported out of the natural gas pipeline through a blowdown valve;

separating the blowdown gas using at least one separator, wherein separating the blowdown gas comprises separating a solid or a liquid from the blowdown gas; and compressing the separated blowdown gas.

12. The process of claim 11, further comprising:

sending the compressed gas into an adjacent natural gas pipeline transporting another gas stream in the adjacent natural gas pipeline to combine the compressed gas with the other gas stream.

13. The process of claim 11, wherein the compressor is a temporary compressor different than in-line compressors used to compress the gas stream flowing through the natural gas pipeline.

14. The process of claim 11, wherein the compressor is a natural gas booster, and wherein compressing the blowdown gas is conducted by the natural gas booster.

15. The process of claim 14, wherein the natural gas booster is an in-line compressor configured to also compress the gas stream flowing through the natural gas pipeline.

16. A process for capturing blowdown emissions in a natural gas pipeline, the process comprising:

sending a blowdown gas to a compressor, wherein the blowdown gas is removed from a gas stream in the natural gas pipeline, and wherein the blowdown gas is transported out of the natural gas pipeline through a blowdown valve;

compressing the blowdown gas; and sending the compressed gas into an adjacent natural gas pipeline transporting another gas stream in the adjacent natural gas pipeline to combine the compressed gas with the other gas stream.

17. The process of claim 16, wherein the compressor is a temporary compressor different than in-line compressors used to compress the gas stream flowing through the natural gas pipeline.

18. The process of claim 16, wherein the compressor is a natural gas booster, and wherein compressing the blowdown gas is conducted by the natural gas booster.

19. The process of claim 18, wherein the natural gas booster is an in-line compressor configured to also compress the gas stream flowing through the natural gas pipeline.

* * * * *